US005970306A

United States Patent [19]

Franzén et al.

[11] Patent Number: 5,970,306

[45] Date of Patent: Oct. 19, 1999

[54] METHOD OF MANUFACTURING HIGH TEMPERATURE RESISTANT SHAPED PARTS

[75] Inventors: Ulf Franzén; Jan Olov Olsson, both of Hallstahammar, Sweden

[73] Assignee: Kanthal AB, Hallstahammar, Sweden

[21] Appl. No.: 08/943,937

[22] Filed: Sep. 30, 1997

Related U.S. Application Data

[63] Continuation of application No. PCT/SE96/00535, Apr. 23, 1996.

[30] Foreign Application Priority Data

Apr. 26, 1995 [SE] Sweden ..... 9501534

[51] Int. Cl.[6] ..... B22F 3/15

[52] U.S. Cl. ..... 419/49; 419/26

[58] Field of Search ..... 75/246; 419/26, 419/49

[56] References Cited

U.S. PATENT DOCUMENTS

| | | | |
|---|---|---|---|
| 3,293,007 | 12/1966 | Wukusick et al. . | |
| 3,964,877 | 6/1976 | Bessen et al. . | |
| 4,023,966 | 5/1977 | Loersch et al. | 75/226 |
| 4,077,109 | 3/1978 | Larson | 29/420 |
| 4,427,447 | 1/1984 | Ramanarayahan et al. | 75/252 |
| 4,443,249 | 4/1984 | Weber et al. . | |
| 4,619,699 | 10/1986 | Petkovic-Luton et al. | 75/252 |
| 5,427,601 | 6/1995 | Harada et al. | 75/235 |

OTHER PUBLICATIONS

Allen, R.E., "Dispersion–hardened iron and nickel alloys", Abstract, Ger.Offen., 12pp., Jan. 1972.

Brentnall et al., "Metal matrix composites for high temperature turbine blades", U.S.N.T.I.S. AD Rep. 1974, NO. 782398/2GA, 1974.

Dialog Information Services, file 351, World Patent Index 81–96, WPI accession No. 92–411330/50, Daido Tokushuko KK: "High electric resistance iron–chromium–aluminuim alloy–comprises container, useful as support catalyst for automobile exhaust gas treatment" & JP,A,4308065, 921030,9250 (Basic).

Patent Abstract of Japan, vol. 17, No. 345, C–1077, abstract of JP,A,5–43976 (Kobe Steel Ltd. et al), Feb. 23, 1993.

Dialog Information Services, File 351, Worlf PAtent Index 81–96, WPI accession No. 92–41329/50, Daido Tokushuko KK: High electrical resistance as heating iron–chromium–aluminum alloy conditions, prepd. by hot compression moulding powder. & JP,A,4308064,921030,9250 (Basic).

*Primary Examiner*—Ngoclan Mai

*Attorney, Agent, or Firm*—Pillsbury Madison & Sutro LLP

[57] ABSTRACT

A method of manufacturing high-temperature-resistant shaped parts of an iron-chromium-aluminum alloy containing 2–10 wt % aluminum, 10–40 wt % chromium, and the balance basically iron is provided. According to this method, the composition in powdered form is hot isostatically pressed to a predetermined shape to form a product. Optionally, the product may be pre-oxidized to form a protective layer of aluminum oxide on a surface thereof.

3 Claims, No Drawings

METHOD OF MANUFACTURING HIGH TEMPERATURE RESISTANT SHAPED PARTS

This is a continuation of PCT/SE96/00535, filed on Apr. 23, 1996, and also claims priority of Swedish application 9501534, filed Apr. 26, 1995.

BACKGROUND OF THE INVENTION

1. Field of the Invention

The present invention is for a method of manufacturing high temperature resistant shaped parts made of a metal alloy.

2. Description of the Related Art

Metallic alloys can, when properly selected with regard to alloy composition, be used at high temperatures. High temperature is in this respect considered to be 1100° C. and higher. Alloys of iron-chromium-aluminum, i.e. FeCrAl alloys, can be used at temperatures as high as 1200–1400° C. and also somewhat higher temperatures. Such alloys have the advantage of being extremely resistant to oxidizing and corrosive environments at high temperatures. On the other hand the use of these alloys has been restricted due to difficulties in shaping parts of more intricate design.

SUMMARY OF THE INVENTION

The method according to the present invention makes it possible to manufacture shaped parts of a high temperature FeCrAl alloy. Shaped parts are considered to be parts and products which are not in the shape of a rod, strip tubes or similar which can be produced by means of extrusion of billets. Shaped parts are for example muffles, tubes, bends, crucibles and burner dies of complicated shape. The invention also comprises a suitable starting material for use in the invented method.

DETAILED DESCRIPTION OF THE INVENTION

With the present invention high temperature resistant shaped parts of FeCrAl alloy are produced from metal powder of desired composition by means of hot isostatic pressing to a predetermined shape in a metal container. The alloy preferrably contains 2–10 weight-% aluminium, 10–40 weight-% chromium, with the balance basically being iron. The alloy can also hold small amounts of for example cobalt, nickel, silicon, manganese, zirconium, titanium, yttrium, vanadium, tantalum and rare earth metals. The present invention also includes alloys with such additions.

The powder used in accordance made by the production method of the invention is produced by atomization of molten metal by known methods. The powder is put into a metal container which can be shaped in such a way as to produce a part which upon hot isostatic pressing is given a shape which is ready for use. The container material is removed by chemical or mechanical means, for example pickling or turning. Another way to produce a powder metallurgical part of finished shape for hot isostatic pressing is metal injection molding (MIM), in which process a mixture of metal powder and a binder is shaped into a green body. The green body is sintered and the binder is burnt off. This method is suited for large series of components, while the method described above using metal capsules lends itself more to single part production.

It is recommended that the surface of the component is preoxidized prior to use. In doing so, a layer of aluminum oxide is formed on the surface. This is also the case under normal operating conditions, when this is done at high temperature and in an oxidizing atmosphere. By preoxidation the properties of the layer can be better controlled and a denser layer can be obtained than would otherwise be the case. Also in a non-oxidizing atmosphere such a layer has good heat resistance. Products manufactured as described in the invention have unique properties in aggressive enviroments, especially in carbon and sulphur containing atmospheres.

We claim:

1. A method of manufacturing high-temperature-resistant shaped parts of an iron-chromium-aluminum alloy, comprising the steps of:

providing a composition in powder form containing 2–10 wt % aluminum, 10–40 wt % chromium, and the balance basically iron, and hot isostatically pressing the composition in powder form to a predetermined shape to form a product.

2. The method of claim 1, further comprising the step of pre-oxidizing the product to form a protective layer of aluminum oxide on a surface thereof.

3. The method of claim 1, wherein the composition further contains one or more additives selected from the group consisting of cobalt, nickel, silicon, manganese, zirconium, titanium, yttrium, vanadium, tantalum, and rare earth metals, and alloys of said additives.

* * * * *